United States Patent [19]

Marcus

[11] 4,014,384

[45] Mar. 29, 1977

[54] BREATHING GAS HEATER FOR USE BY A DIVER COMPRISING DOUBLE WALLED CYLINDER AND INNER CONTAINER FILLED WITH HOT LIQUID PRIOR TO USE

[76] Inventor: Douglas Larry Marcus, 2814 Smith Ave., Baltimore, Md. 21209

[22] Filed: Mar. 31, 1975

[21] Appl. No.: 563,410

Related U.S. Application Data

[63] Continuation-in-part of Ser. No. 457,204, April 2, 1974, Pat. No. 3,898,978.

[52] U.S. Cl. ..... 165/104 S; 128/212; 165/135

[51] Int. Cl.[2] ..... F28D 13/00

[58] Field of Search ..... 128/212; 165/104 S, 165/135

[56] References Cited

UNITED STATES PATENTS

| | | | |
|---|---|---|---|
| 1,132,138 | 3/1915 | Whitney | 128/212 |
| 3,107,669 | 10/1963 | Gross | 128/212 |
| 3,195,620 | 7/1965 | Steinhardt | 165/135 |
| 3,315,846 | 4/1967 | Landis et al. | 165/135 |
| 3,443,632 | 5/1969 | Sauer | 165/135 |
| 3,492,461 | 1/1970 | Lawrence | 165/104 S |

*Primary Examiner*—William L. Freeh
*Assistant Examiner*—G. P. La Pointe

[57] ABSTRACT

A self-contained, portable breathing gas heating system to be used by a diver for submersion in a cold environment consisting of a heat exchanger in an insulated container and a preheated liquid through which the breathing gas circulates in tubing connecting the breathing gas source (tank) to the breathing outlet which is secured in the mouth of the diver.

5 Claims, 7 Drawing Figures

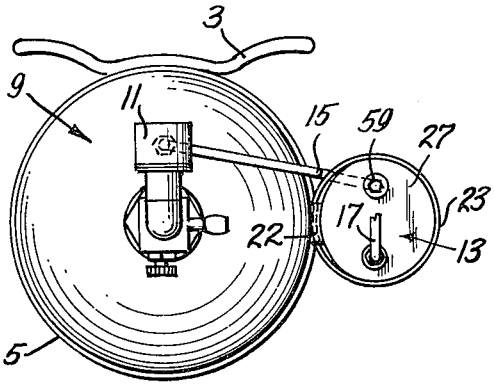
Fig. 2.
Fig. 1.
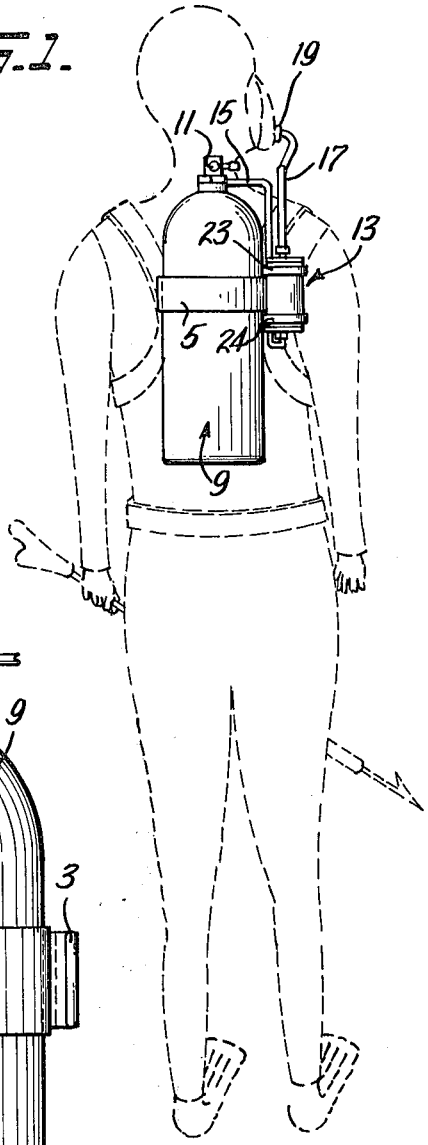
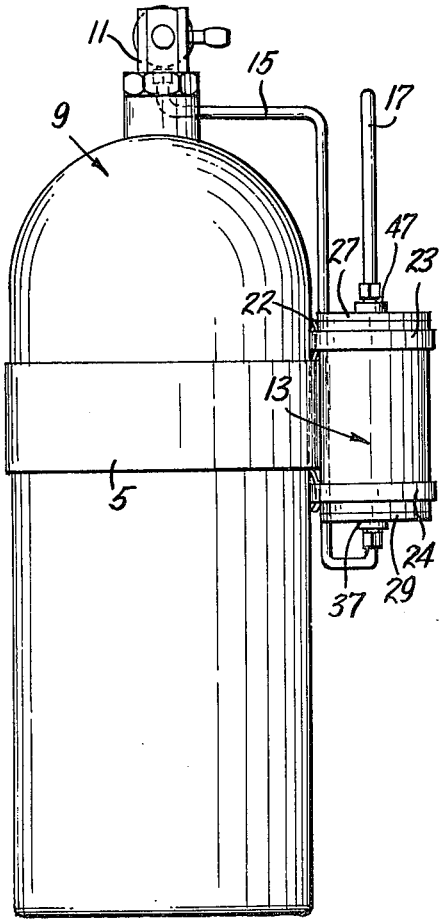
Fig. 3.
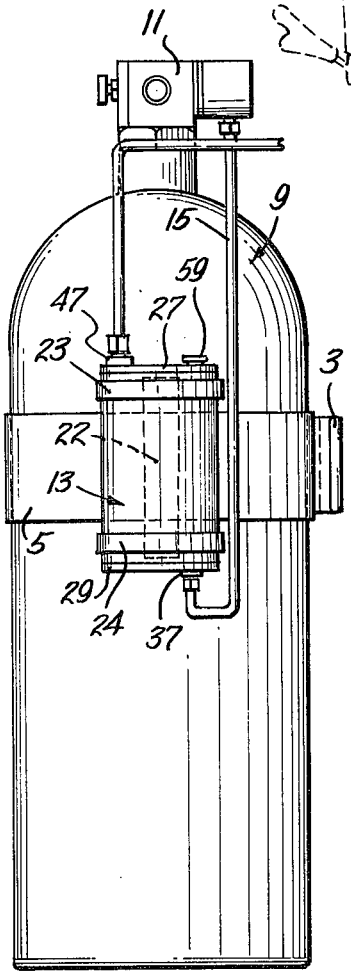
Fig. 4.

Fig. 5.
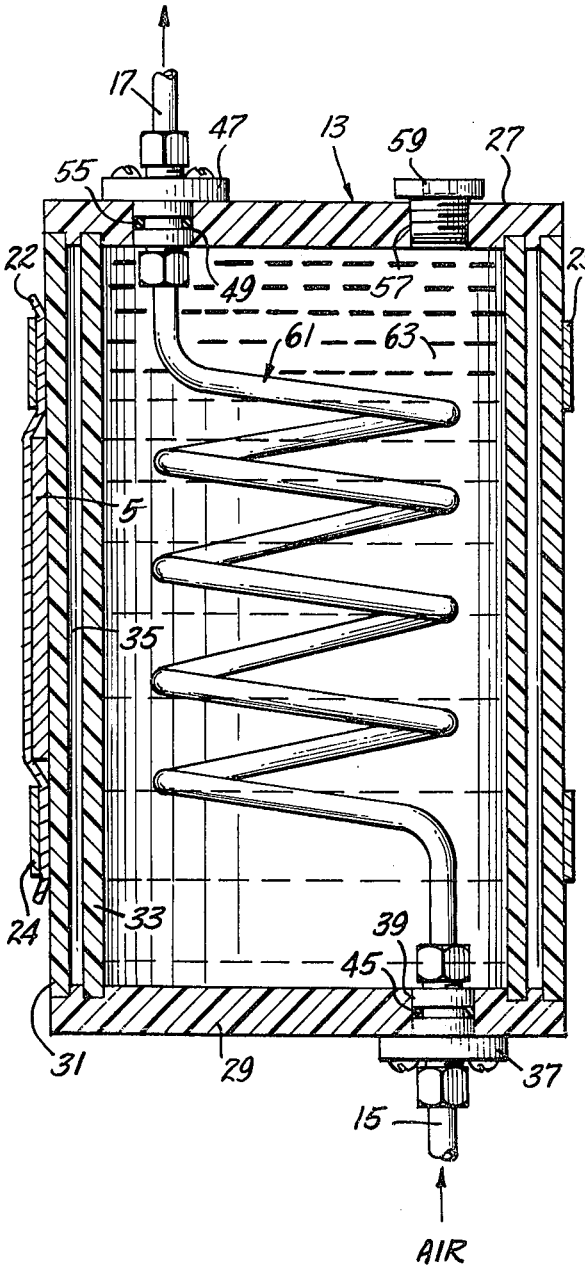
Fig. 7.
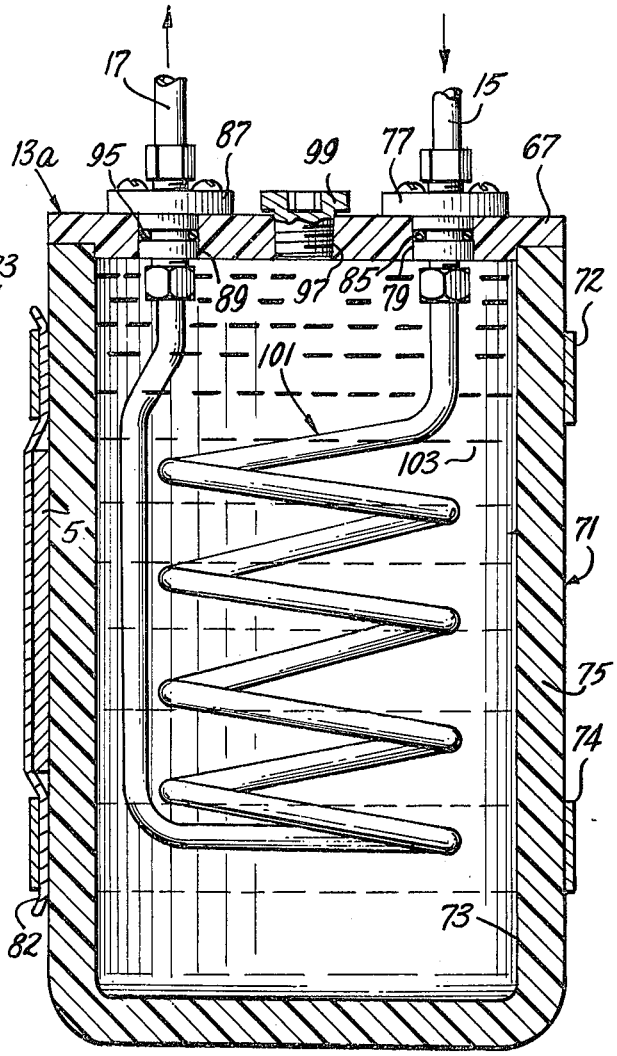
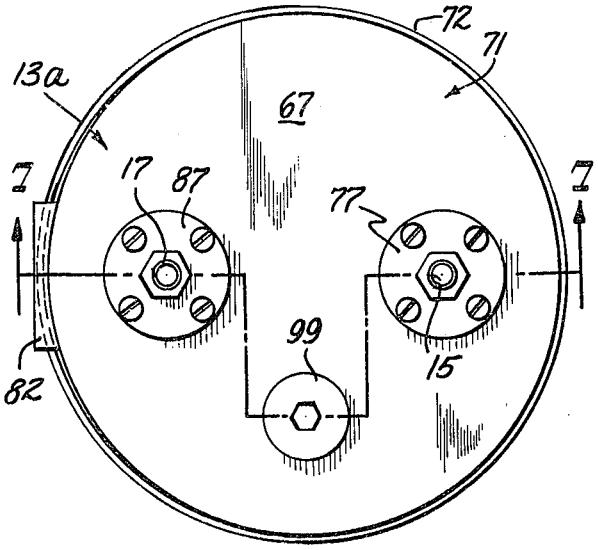
Fig. 6.

BREATHING GAS HEATER FOR USE BY A DIVER COMPRISING DOUBLE WALLED CYLINDER AND INNER CONTAINER FILLED WITH HOT LIQUID PRIOR TO USE

CROSS REFERENCES TO RELATED APPLICATION

This application is a continuation-in-part of application Ser. No. 457,204, entitled Breathing Gas Heater, filed Apr. 2, 1974, now U.S. Pat. No. 3,898,978.

BACKGROUND OF THE INVENTION

Field of the Invention

The invention is in the field of self-contained, portable breathing gas heating system to be used by a diver for submersion in a cold environment.

More specifically, the invention is in the field of methods of supplying heat to breathing gas by filling a heat exchanger with a preheated liquid just before the diver submerges in a cold marine environment whereby the breathing gas from the tank is heated for a short period of time, up to 3 hours, by heat exchange between the hot liquid and the gas passing from the tank through the heat exchanger to the diver's mouth in the conventional face mask. A predetermined amount of hot liquid in a relatively small amount provides adequate heat to permit the diver to do useful work safely and efficiently as long as the breathing gas had been preheated to a degree which permits the delivery of 100 BTU to 300 BTU per hour to the diver.

Prior Practice to Provide Diver Comfort

The ideal method of keeping a diver warm would be a self-contained heating unit. The requirements for this type of equipment are quite stringent as free swimmers are limited by the size and weight of the heat source. Also, positive and accurate control of the temperature provided is necessary, and the system must be failsafe to insure that the diver cannot be burned. One most important item, overlooked in the prior art is that the entire system must be simply constructed so as to appeal to manufacturers for its economic production requirements as well as to users for its low cost and low maintenance.

Steps taken toward providing diver comfort have included the use of a wet suit, generally made of foamed neoprene as insulation, and the development of a water tight multiple clothing layered dry suit for colder temperatures. Due to heat losses encountered with the two different types of suits, it has become evident that a heat replacement system is necessary for deep or prolonged dives. At present, no suit alone is capable of keeping a diver in proper heat balance for very long periods of time. This heat must be provided from an external source.

Many methods have been tried including isotope, electrical and chemical heat sources, all with the distinct disadvantages of high cost or excessive weight. It must be noted that in various experiments with subjects in heated suits, while the heat loss from the body surface remained minimal, core temperatures fell steadily. There is general agreement that supplemental heating is required for the diver, not only for his surface heat loss but for the heat loss from his respiratory tract.

Description of the Prior Published Patent Art

Heat devices have been used heretofore to permit warming of the body as for example, in Mossor, U.S. Pat. No. 1,199,914, Oct. 3, 1916, shows a leg warming boot constructed with a double wall, the space between the walls filled with hot water or other fluid. However, such devices have not been used in order to permit a diver to engage in useful work by submerging in a cold marine environment and in any event, if used in the manner as taught in this patent, would not serve to heat the breathing gas from the tank to the diver's mouthpiece.

In the patent to Fletcher et al, U.S. Pat. No. 3,744,555, July 10, 1973, a very complex cooling device is shown for cooling a garment, but again this is not a concept that the breathing gas from the diver's tanks can be adequately heated by pouring hot liquid into a heat exchanger in order to warm the breathing gas which circulates in tubing through said chamber.

I am also aware of the teachings in the patents to Whitney, U.S. Pat. No. 1,132,138, Mar. 16, 1915 and Gleockler, U.S. Pat. No. 3,140,590, July 14, 1964, which serve to cool inhaling gas and humidify it with ice cubes. The present method of heating by providing a predetermined amount of hot liquid is opposite to the teachings of these patents.

I am also aware of the teaching of Nicastro, U.S. Pat. No. 3,318,307, May 9, 1967, which shows the combination of heater 16 in heat exchanger to heat the air for breathing in a face mask, but the present invention is clearly different in concept.

I am aware of Mullen, U.S. Pat. No. 2,053,528, Sept. 8, 1936, which shows that coil coolers are old, but these have not been used for heating breathing gas for a diver for submersions in a cold marine environment.

SUMMARY OF THE INVENTION

Based on the fact that respiratory heat loss can amount to more than one-third of the total thermal loss, it is essential that a breathing gas heater, adapted to the present compressed gas diving system replenish this loss. In conjunction with some of the better diving garments available today, notably the inflatable dry suit type, a breathing gas heater would thereby complete the total diver comfort system.

In accordance with the invention, heated breathing gas can be obtained by passing the gas through coiled tubing in an insulated heat exchanger containing a preheated liquid, notably water. Sufficient thermal energy can be obtained from the proper volume of heated fluid to maintain comfortable breathing gas temperatures for long periods of time.

Unlike other heat sources such as batteries, chemical reactions or isotopes, water or any easily obtainable fluid can be heated and added to the insulated heat exchanger many times with no inconvenience, little cost and virtually no waiting. This consumable heat source is reliable and far more easily obtained than any other thermal energy source. This heated gas is breathed directly by the diver through the final stage of the regulator.

In accordance with the invention, the enclosed fluid is preheated. This is done to reduce equipment requirements such as known to the art, they can be added for complete self-containment of the system but are not necessary if hot fluid is available before a dive. This addition of fluid to the chamber before every dive aids in maintenance as it keeps the internal tubing clean and free of scale and algae which reduce heat transfer.

This system works satisfactorily enough to utilize hot tap water (160° F) to produce hot breathing gas (90° to 100° F) for more than 1 hour while submerged in a 41° F environment.

The standard model for most sport and commercial diving activity will heat compressed air with approximately 3 pounds of water, seawater, etc., for the duration of most dives up to 3 hours. Larger amounts of heated fluid are necessary for the various gas mixtures including helium-air and helium-oxygen. Experiments have shown that warm water (124° F) can keep air between 75° and 90° F for at least ninety minutes.

OBJECTS OF THE INVENTION

A fact as old as diving itself and becoming increasingly important as divers go deeper for longer periods is that heat must be provided for the diver. The object of any dive is to achieve useful work, and a diver will achieve useful work safely and efficiently, if he is warm and comfortable.

Another object of the invention is to provide a simple method for charging a heat exchanger with hot liquid, such as fresh water or seawater, water-ethylene glycol, water-glycerol, which can be used to heat the breathing air passing through the heat exchanger to thereby permit the diver to do useful work.

Still a further object is to provide a new portable gas heating apparatus for attachment to the compressed air breathing tanks which utilizes a heated fluid charged to an insulated heat exchanger in the apparatus.

Further objects will be apparent from the drawings and more detailed description.

BRIEF DESCRIPTION OF THE DRAWINGS

FIG. 1 is a rear elevational view of a heating attachment for a portable breathing gas system;

FIG. 2 is an enlarged plan view of the apparatus of FIG. 1;

FIG. 3 is a rear elevational view of the apparatus of FIG. 2;

FIG. 4 is a side elevational view of the apparatus of FIG. 3;

FIG. 5 is an enlarged vertical sectional view through the heater attachment of FIG. 4;

FIG. 6 is a plan view of a modified form of heater attachment; and,

FIG. 7 is a vertical sectional view, taken on the staggered section line 7—7 of FIG. 6 showing a single wall container constructed of rigid thermosplastic foam (PVC preferred).

DESCRIPTION OF THE PREFERRED EMBODIMENTS

In my parent application Ser. No. 457,204, filed Apr. 2, 1974, I illustrate the general arrangement of the apparatus elements for the diver in similar figures as FIGS. 1 – 4 herein. The diver's tank 9 is shown in FIG. 1 and is in place for use by the diver and the views of the heat exchanger are best seen in FIGS. 5 and 7. In FIGS. 2, 3 and 4, the plan, rear elevational, and side elevational views clearly demonstrate that the present apparatus of the invention provides substantially no material enlargement of the size or weight of the portable breathing system used by the diver in comparison with the ordinary self-contained, portable breathing apparatus used by the diver, which omits the heat exchanger. In short, the weight and size of the heat exchanger is relatively small in comparison with the weight and size of the apparatus.

In FIGS. 5 and 6, there are illustrated two embodiments of the breathing gas heater in which the heat exchanger is shown as an insulated double wall. Both of the apparatuses of FIGS. 5 and 6 are designed to be worn alongside the diver's tank 9 (see FIG. 3 for the gas cylinder) and behind the diver out of the way.

The diver's tank 9 is supported by the tank band 5, which holds the tank to the diver's back support 3 (FIG. 2). The heat exchanger 13 in FIG. 5 takes compressed gas from the diver's tank 9 through a standard diver's regulator 11 by way of hose 15 attached to fitting 37 shown in bottom 29 of FIG. 5.

In the FIG. 7 embodiment, the heat exchanger **13*a* made of structural foam plastic takes compressed gas from the diver's tank through a standard diver's regulator 10 by way of hose 16 attached to fitting 103 shown in the bottom 108 in FIG. 5 or at the top 107 of FIG. 6**.

The heat exchanger **13*a*** is light in weight and is easily manufactured by known techniques. References is made to *RIGID PLASTICS FOAMS* by T. H. Ferrigno, Reinhold Publishing Corporation, 1963. In this book reference is made to the manufacture of rigid plastics foams wherein the examples of foams are urethanes, polystyrene foams, epoxy foams, polyvinyl chloride foams, phenolic resin foams, urea-formaldehyde foams, and silicone foams. Still other foams are described in this book such as cellulose acetate, acrylic, polyester, asphalt, and others. Any of these foams may be used.

However, the most preferred foam is a polyvinyl chloride foam, which is commercially available by foaming processes such as solvated gas and gas releasing agents and is available also in cross-linked plasticizer modifications.

Note that fitting 37 in FIG. 5 corresponds to fitting 77 in top 67 of FIG. 7 of the heat exchanger. The compressed gas passes through coiled tubing 61 of FIG. 5, 101 of FIG. 7, absorbing heat from heated fluid 63 (FIG. 5), 103 (FIG. 7) contained in the heat exchangers 13 and **13*a*, respectively, and exits through 47, 87 by way of hose 17 to be breathed by the diver through mouthpiece 19**.

The heat exchangers in FIGS. 5 and 7 are insulated to external heat losses by the double walled housing 31, 33 or the air gap 35 or by the rigid PVC foam 75. The alternative to the double walled container is the lightweight rigid structural foam molded container, which combines required strength and support with the necessary insulating requirements and minimizes housing parts permitting easier manufacturing.

Heated fluid 63, 103, notably water, is poured into the internal chamber 33, 73 of the heat exchanger through water port 57 in top of 27 (FIG. 5) or port 97 in top of 67 (FIG. 7) immediately preceding a dive. The water is contained by plugs 59 or 99. Availability of heated water makes repetitive diving simple and convenient. "O" rings 45, 55, 85, 95 provide necessary seals of air fittings 37, 47, and 77, 87 seated in respective openings 39, 49 and 79, 89.

The heater is to be supported by two straps 23, 24 (FIG. 5) and 72, 74 (FIG. 7) holding heater support 22, 82, which is fitted between tank 9 and tank band 5.

The compressed gas, which passes through coiled tubing 101 in both FIGS. 5 and 7 embodiments absorbing heat from the heated fluid 112 contained in the heat exchanger 113, may be air, air-helium, oxygen-helium, or oxygen. The gas exits through fitting 102 by way of hose 18 to be directly breathed by the diver.

It is seen that the rigid structural foam molded container 111 shown in FIG. 7 combines required strength and support with the necessary insulating characteristics and permits easier manufacturing.

The heated fluid 112, notably water, may be mixtures of water, fresh water, or seawater with glycerol or ethylene glycol and is poured into the internal chamber of the heat exchanger through water port 109 in 107 immediately preceding a dive. The availability of heated water makes repetitive diving simple and convenient. O rings 110 provide necessary seals for air fittings 102, 103 and tubing 101.

What is claimed is:

1. A portable gas heating apparatus for attachment to a pressurized gas source to help maintain diver comfort in a cold aqueous environment by producing heated breathing gas, comprising:

a heat exchanger comprising metal tubing in an insulated walled chamber adapted to contain a hot liquid used to heat the breathing gas which circulates through said metal tubing;

a heated liquid at 124°–160° F in said chamber which is charged to said chamber just preceding a dive by the diver, said liquid selected from the group consisting of fresh water, seawater, glycerol, ethylene glycol and mixtures of glycerol or said glycol with water;

the volume of said liquid based upon the kind of breathing gas which is selected from the group consisting of air, oxygen, helium-air mixture and helium-oxygen mixture and delivering for every three pounds of heated fluid at 124° F a breathing temperature of between about 75° to 90° F for at least 90 minutes; and, inlet and outlet tubes to supply compressed gas to the heater and lead heated breathing gas from said metal tubing from said heat exchanger to the diver.

2. The apparatus as set forth in claim 1 in which the wall of the insulated chamber is molded from a rigid structural foam plastic.

3. The apparatus as set forth in claim 1 in which the insulated chamber is provided with a double wall.

4. The apparatus as set forth in claim 1 in which said metal tubing carries air entering through the bottom and said metal tubing exits through the top of the heat exchanger.

5. The apparatus as set forth in claim 1 in which the air carried by said metal tubing enters and exits through the same end of said heat exchanger.

* * * * *